US006488592B1

(12) United States Patent
Boatner

(10) Patent No.: US 6,488,592 B1
(45) **Date of Patent: *Dec. 3, 2002**

(54) APPARATUS AND METHOD FOR TEACHING GOLF

(76) Inventor: Barry D. Boatner, 1720 Ridge Ave., Holly Hill, FL (US) 32117

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,047

(22) Filed: Jan. 20, 1998

(51) Int. Cl.[7] ..... A63B 57/00
(52) U.S. Cl. ..... 473/220
(58) Field of Search ..... 473/220, 218, 473/219, 278, 257, 270, 273, 156, 258, 260–262, 186.3, 186.4, 174, 150, 159

(56) References Cited

U.S. PATENT DOCUMENTS

| | | | | |
|---|---|---|---|---|
| 2,707,638 A | | 5/1955 | Manley | |
| 3,281,586 A | | 10/1966 | Gonzalez | |
| 3,820,795 A | * | 6/1974 | Taylor | 473/220 |
| 3,868,109 A | | 2/1975 | Fowler | |
| 3,953,034 A | | 4/1976 | Nelson | 473/220 |
| 4,456,257 A | | 6/1984 | Perkins | |
| 4,693,479 A | | 9/1987 | McGwire | |
| 4,805,912 A | * | 2/1989 | Hickman | 473/174 |
| 4,913,441 A | | 4/1990 | Freer | |
| 4,971,328 A | | 11/1990 | Hernberg | |
| 5,000,456 A | | 3/1991 | Rabold | |
| 5,082,282 A | | 1/1992 | Hernberg | |
| 5,139,263 A | | 8/1992 | Feo | |
| 5,154,427 A | | 10/1992 | Harlan et al. | |
| 5,161,802 A | | 11/1992 | Daechsel | |
| 5,207,429 A | | 5/1993 | Walmsley et al. | 473/220 |
| 5,269,528 A | | 12/1993 | McCardle, Jr. | |
| 5,288,080 A | | 2/1994 | Tice | |
| 5,388,831 A | | 2/1995 | Quandri et al. | 473/220 |
| 5,401,030 A | | 3/1995 | Halliburton | |
| 5,435,562 A | | 7/1995 | Stock et al. | |
| 5,467,991 A | | 11/1995 | White, IV et al. | |
| 5,470,072 A | | 11/1995 | Cunningham | |
| 5,472,204 A | | 12/1995 | English et al. | |
| 5,494,290 A | | 2/1996 | Stefanoski | |
| 5,527,041 A | | 6/1996 | Terry, III | |
| 5,544,888 A | | 8/1996 | Pellegrini | |
| 5,593,354 A | | 1/1997 | Falossi et al. | |
| 5,655,973 A | | 8/1997 | McPherson, Jr. | |
| 5,665,006 A | | 9/1997 | Pelligrini | 473/220 |
| 5,685,782 A | | 11/1997 | Lipps et al. | |
| 5,759,110 A | | 6/1998 | Seibel et al. | |
| 5,848,944 A | | 12/1998 | Brannen | 473/409 |
| 5,882,266 A | | 3/1999 | Schaum | 473/220 |
| 5,954,592 A | | 9/1999 | Laffer et al. | 473/220 |

FOREIGN PATENT DOCUMENTS

| | | |
|---|---|---|
| EP | 0449239 | 10/1991 |

* cited by examiner

*Primary Examiner*—Mark S. Graham
*Assistant Examiner*—Raeann Gorden
(74) *Attorney, Agent, or Firm*—Wenderoth, Lind & Ponack, L.L.P.

(57) ABSTRACT

A method for teaching golf. The method includes the use of a conventional golf club, a handle laser removably attached to a butt end of the golf club's handle, a shaft laser removably attached to the golf club's shaft, and a retractable target line having a tape marked with a centerline and at least one golf ball image. The handle laser is installed so as to shine a handle laser beam along the golf club's shaft centerline extension in a direction opposite the golf club's head. The shaft laser is installed so as to shine a shaft laser beam parallel to the golf club shaft such that the shaft laser beam passes immediately in front of the area of the head intended to strike a golf ball. The method includes the steps of addressing the golf ball image and swinging conventionally, ensuring that during appropriate arcs of the swing, either the handle laser beam or the shaft laser beam shine on the tape centerline, thus teaching the golf student to execute the entire swing within the perfect swing plane.

8 Claims, 5 Drawing Sheets

FIG 2
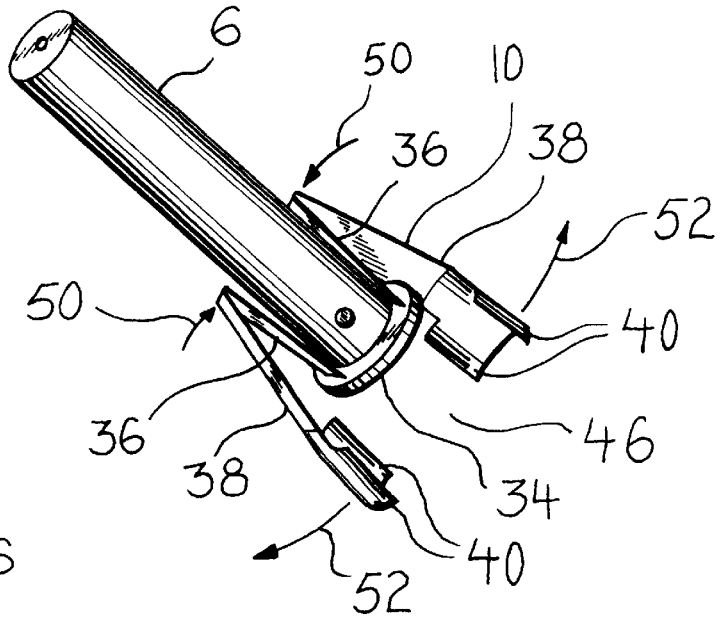
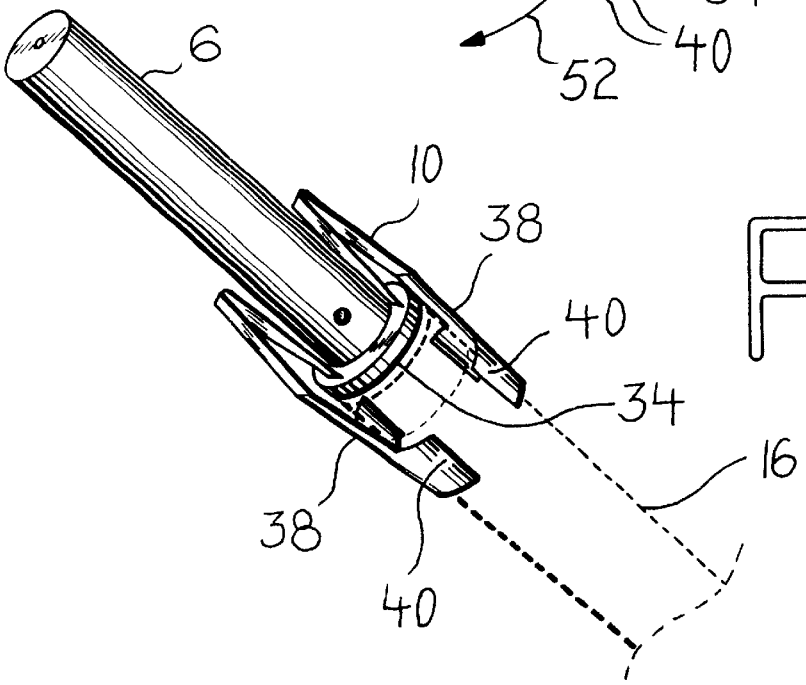
FIG 3

APPARATUS AND METHOD FOR TEACHING GOLF

BACKGROUND OF THE INVENTION

1. Field of the Invention

This invention relates to golf instruction, and in particular to an apparatus and method for teaching golf.

2. Background of the Invention

It is generally accepted that golf first emerged in Scotland around 1100 AD. It was based on a Roman game called paganica, which used a bent stick and a leather ball stuffed with feathers. Golf was banned in Scotland from 1457 until 1502 by King James II because its popularity threatened archery practice, which was necessary for national defense. In 1502 England and Scotland signed a treaty of perpetual peace, and the play of golf resumed.

Until 1848 golf was played with a feather-stuffed leather ball called "the feathery". In 1848 golfers started using a solid gutta-percha ball called "the gutty", and in 1899 an American inventor introduced the liquid-center golf ball.

The oldest golf club in continuous existence is the Ancient Golf Club of St. Andrews, located in Edinburgh, Scotland (established 1744). This club established many of the standards of the game, including fixing the length of the course at 18 holes. The Royal Montreal Golf Club was established in 1873, and ranks as the oldest North American golf club. In the United States, the St. Andrews Golf Club was established in Yonkers, N.Y. in 1888, and was the first United States golf club.

Today, more people play golf than any other outdoor sport. More than 16 million people play golf in the United States alone every year. The game has become popular in many places, including the United States, Canada, England, Western Europe, and Japan.

Conventional golf courses feature either nine or 18 holes. A round of golf consists of 18 holes played in a predetermined sequence. During play, golfers attempt to keep the ball on the fairway, a stretch of mowed grass between the tee-off site and the putting green, which contains the hole into which the ball must be sunk. The edges of the fairways frequently have obstacles called bunkers. These bunkers may be a mound or a sand trap, or sometimes a body of water such as a stream, pond, lake, river or ocean.

About half the holes of an 18-hole course are medium holes, and measure from approximately 280–455 yards in length. The other holes are divided between short holes (less than 280 yards) and long holes (longer than 485 yards). Consequently, 18-hole golf courses occupy between 90 and 250 acres.

The large area of ground required for golf courses and the length of the individual holes necessitates a smooth, accurate swing on the part of the golfer. Ideally, the golf club should swing within a plane containing the golf ball to be hit, from initial address of the ball, through back-swing, through the forward part of the swing, and finally throughout the follow-through portion of the stroke. This plane is referred to as the "perfect swing plane", and it is important that the golfer keep the golf club within the perfect swing plane throughout the stroke as much as possible, in order to maximize the solidity and accuracy of the shot.

One problem associated with teaching golf students to swing within the perfect swing plane is the invisible nature of this plane. The student is told to keep his swing within a plane containing the ball, yet this plane is invisible and, for some students, difficult to visualize. In addition, due to the invisible nature of the plane, it is difficult for the student to tell if his swing is indeed within the perfect swing plane, and consequently it is hard to make appropriate swing corrections to advance in the learning process.

One solution to the problem of student visualization of the perfect swing plane is to attach lights to golf clubs or other swingable devices, and have the student watch the lights. A variety of light types have been proposed for this purpose, including incandescent, stroboscopic, and laser.

Existing Designs

A number of patents have been granted which teach a light mounted on the butt end of a golf club or other swingable device. U.S. Pat. Nos. 4,693,479, 4,913,441, 5,544,888 and 5,655,973 were granted to McGwire, Freer, Pellegrini and McPherson, Jr. respectively for butt-mounted lights. While these designs permitted the student to visually observe the swing plane while the butt end of the club or other swingable device was pointing down towards the ground, these devices made no provision for tracing the swing plane during that part of the swing that the head end of the golf club or other swingable device was pointing toward the ground (as during the forward portion of the swing). In addition, none of these inventions provided a clearly defined target line against which to compare the butt-mounted light tracing.

A second school of thought relating to club-mounted lights taught lights either mounted in the head end of a golf club, or lights mounted on the shaft pointing downwards, toward the golf club head. U.S. Pat. Nos. 4,971,328, 5,000,456, 5,161,802, 5,467,991 and 5,472,204 were granted Hemberg, Rabold, Daechsel, White IV et al., and English et al. for such designs. While these designs permitted the student to visually observe the swing plane while the head end of the club or other swingable device was pointing down towards the ground, these devices made no provision for tracing the swing plane during that part of the swing that the butt end of the golf club or other swingable device was pointing toward the ground (as during the backswing and follow-through portions of the swing). In addition, none of these inventions provided a clearly defined target line against which to compare the light tracing.

Still another approach involved mounting lights to the top of a golf club head, so the golf student could more easily observe the trajectory of the golf club head during a swing, especially under dim lighting conditions. U.S. Pat. Nos. 5,288,080 and 5,470,072 were granted Tice and Cunningham respectively for such devices. These designs did little more than highlight the golf club head to facilitate its visibility. In addition, they did not indicate the swing plane of the entire golf club, but rather the swing arc of the head only, thus providing potentially misleading information to the golfer.

Cunningham '072 additionally taught a back-lit silicone pad against which to compare the golf club head trajectory in close vicinity to a ball target. This pad suffered from a number of disadvantages. The pad was of only short length, and thus rendered it's use effective during only a short arc of the swing. In addition, the pad was cumbersome to transport, and complex, being electrically back-lit.

McCardle was granted U.S. Pat. No. 5,269,528 for a cylinder which incorporated a light at each end. While this device allowed the cylinder light tracings to be observed from two ends of the cylinder, no provision was taught to allow the lights to be mounted to a conventional golf club. Thus, a swing practiced with the '528 cylinder taught the student how to swing the '528 cylinder, not how to swing a conventional golf club. In addition, no clearly defined target line against which to compare the light tracings was disclosed.

SUMMARY OF THE INVENTION

Accordingly, it is an object of the present invention to provide an apparatus and method for teaching golf which teaches a golf student to swing within the perfect swing plane. Design features allowing this object to be accomplished include a handle laser, a shaft laser, and a retractable target line having an optically reflective tape with centerline and golf ball image. Advantages associated with the accomplishment of this object include increased solidity and accuracy of golf shots.

It is another object of the present invention to provide an apparatus and method for teaching golf which can be used in conjunction with existing golf clubs, without the need to modify the existing golf club in any way. Design features allowing this object to be accomplished include a handle laser clamp having a handle laser clamp aperture sized to grip a conventional golf club handle, and a shaft laser clamp having a first handle laser clamp aperture sized to grip a conventional golf club shaft. Benefits associated with the accomplishment of this object include increased flexibility in swinging golf clubs, and improved learning and transferability of learning results, because the actual club used to teach will be later used during play. In addition, no modifications need be made to existing golf equipment, such as drilling holes, etc., thus maintaining the integrity and balance of the golf clubs used.

It is still another object of this invention to provide an apparatus and method for teaching golf which is quick and simple to install and uninstall. Design features enabling the accomplishment of this object include a handle laser clamp having a handle laser clamp aperture sized to grip a conventional golf club handle, a shaft laser clamp having a first handle laser clamp aperture sized to grip a conventional golf club shaft and a retractable target line with lock. Advantages associated with the realization of this object include ease of use and convenience in storage and transportation.

It is yet another object of this invention to provide an apparatus and method for teaching golf which is inexpensive and readily available. Design features allowing this object to be achieved include the use of components made of off-the-shelf and readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIGS. 2 and 3. Sheet three contains FIG. 4. Sheet 4 contains FIGS. 5–8. Sheet five contains FIGS. 9–11.

FIG. 2 is a front isometric view of a handle laser clamp with arms held apart, ready to be mounted on a golf club handle.

FIG. 3 is a front isometric view of a handle laser clamp mounted on a golf club handle.

DETAILED DESCRIPTION OF THE PREFERRED EMBODIMENT

Figure 1:
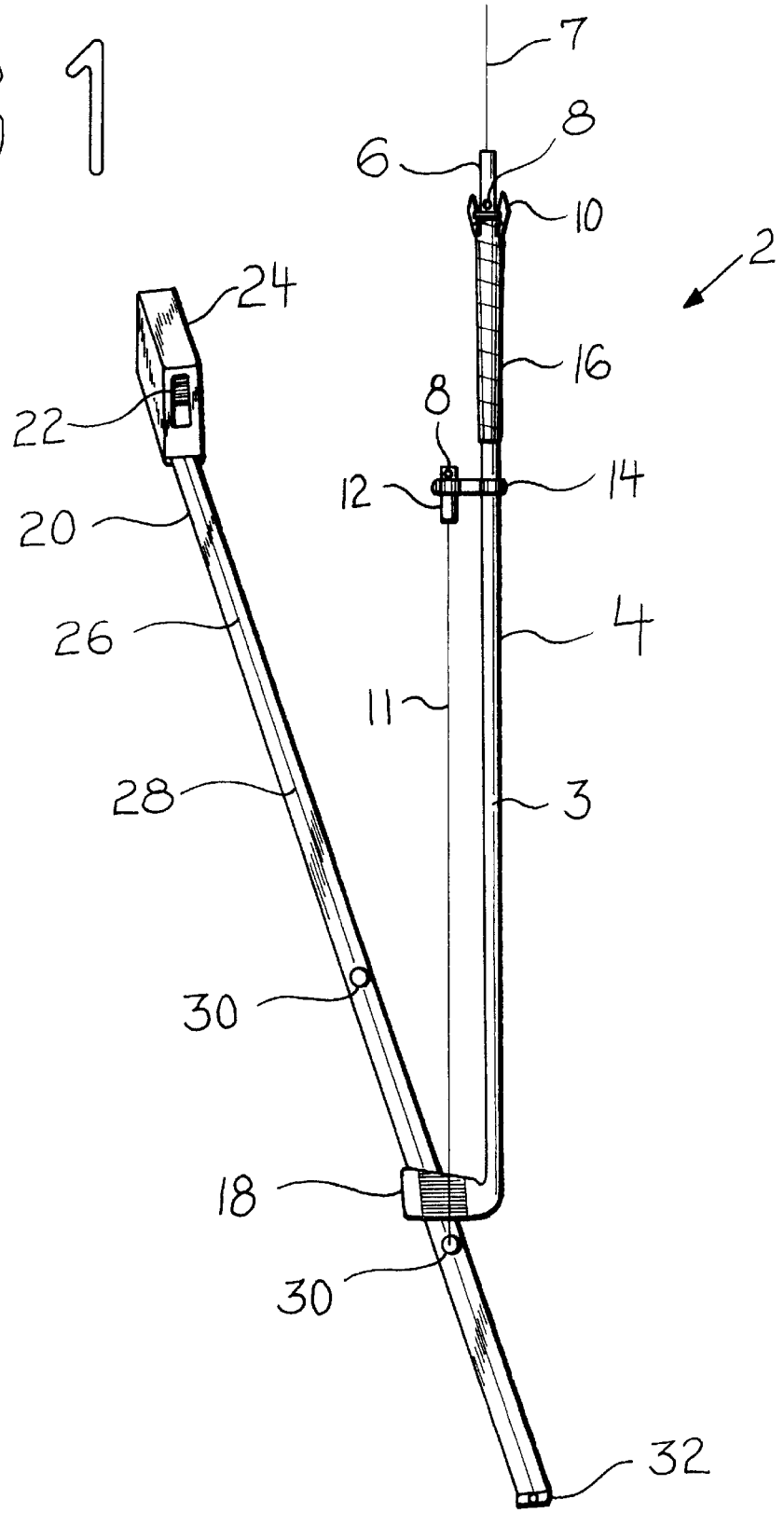
FIG. 1 is a front isometric view of a golf teaching apparatus installed on a golf club.

Referring now to FIG. 1 we observe golf teaching apparatus 2 mounted to golf club 4. Golf teaching apparatus 2 comprises handle laser 6 mounted to handle 16 by means of handle laser clamp 10, shaft laser 12 mounted to shaft 3 by means of shaft laser clamp 14, and retractable target line 20. Handle laser 6 comprises ON/OFF switch 8, which turns handle laser beam 7 on and off. Shaft laser 12 comprises ON/OFF switch 8, which turns shaft laser beam 11 on and off. When correctly installed, handle laser beam 7 shines along a centerline extension of shaft 3 in a direction opposite head 18. When correctly positioned, shaft laser beam 11 shines parallel to shaft 3 and passes immediately in front of the surface of head 18 used to strike a golf ball.

Retractable target line 20 comprises housing 24, tape 26, and lock 22. Tape 26 is spring-loaded to retract within housing 24, and may be retained in an extended position as illustrated in FIG. 1 by means of lock 22. Stop 32 prevents tape 26 from inextricably retracting within housing 24. Tape 26 bears two ball images 30 and centerline 28 on one surface. In the preferred embodiment, tape 26 was 12 feet long, and bore a first ball image 30 three feet from stop 32 used for putting practice, and a centrally located second ball image 30 six feet from stop 32 used for driving practice. The surface of tape 26 bearing ball image 30 and centerline 28 is marked with a photo-reflective coating which glows when visible light is shined on it, such as is currently commercially available to be applied to gate posts and other road signs to enhance their visibility at night when illuminated with car headlights.

FIG. 2 is a front isometric view of handle laser clamp 10 ready to be mounted on golf club handle 16. Handle laser clamp 10 comprises a plurality of upper arms 36 mounted to base 34. Base 34 is of circular shape and has two flats, and is substantially co-extensive with the butt end of handle 16. Handle laser 6 is mounted on one flat of base 34, perpendicular to base 34. Upper arms 36 are mounted on the same base 34 flat as handle laser 6. A lower arm 38 is attached to each upper arm 36 at an acute angle, and each lower arm 38 terminates in fingers 40 which are arcuately shaped so as to conform to the curvature of handle 16. Lower arms 38, fingers 40, and a base 34 flat opposite handle laser 6 define handle laser clamp aperture 46, sized to accommodate the butt end of handle 16 when lower arms 38 are held apart as depicted in FIG. 2.

Upper arms 36 and lower arms 38 are spring-loaded so as to hold the extremes of lower arms 38 opposite upper arms 36 in close proximity to each other, such that at rest, the distance between the extremes of lower arms 38 opposite upper arms 36 is less than the butt end diameter of handle 16. In the preferred embodiment, upper arms 36 and lower arms 38 were made of resilient material such as springy metal, resilient synthetic, or other appropriate material.

Handle laser clamp 10 is mounted to handle 16 by pressing opposing pairs of upper arms 36 toward each other as indicated by arrows 50, thereby forcing the extremes of lower arms 38 opposite upper arms 36 apart as indicated by arrows 52. The butt end of handle 16 is then inserted into handle laser clamp aperture 46 until base 34 rests solidly on the butt end of handle 16, thus positioning handle laser beam 7 to shine along the centerline of shaft 3 in a direction opposite head 18. Finally, upper arms 36 are released. Because upper arms 36 and lower arms 38 are spring-loaded so as to hold the extremes of lower arms 38 opposite upper arms 36 less distance apart than the butt end diameter of handle 16, lower arms 38 and fingers 40 will securely grip handle 16, thus holding handle laser 6 in place, as depicted in FIG. 3.

Figure 4:
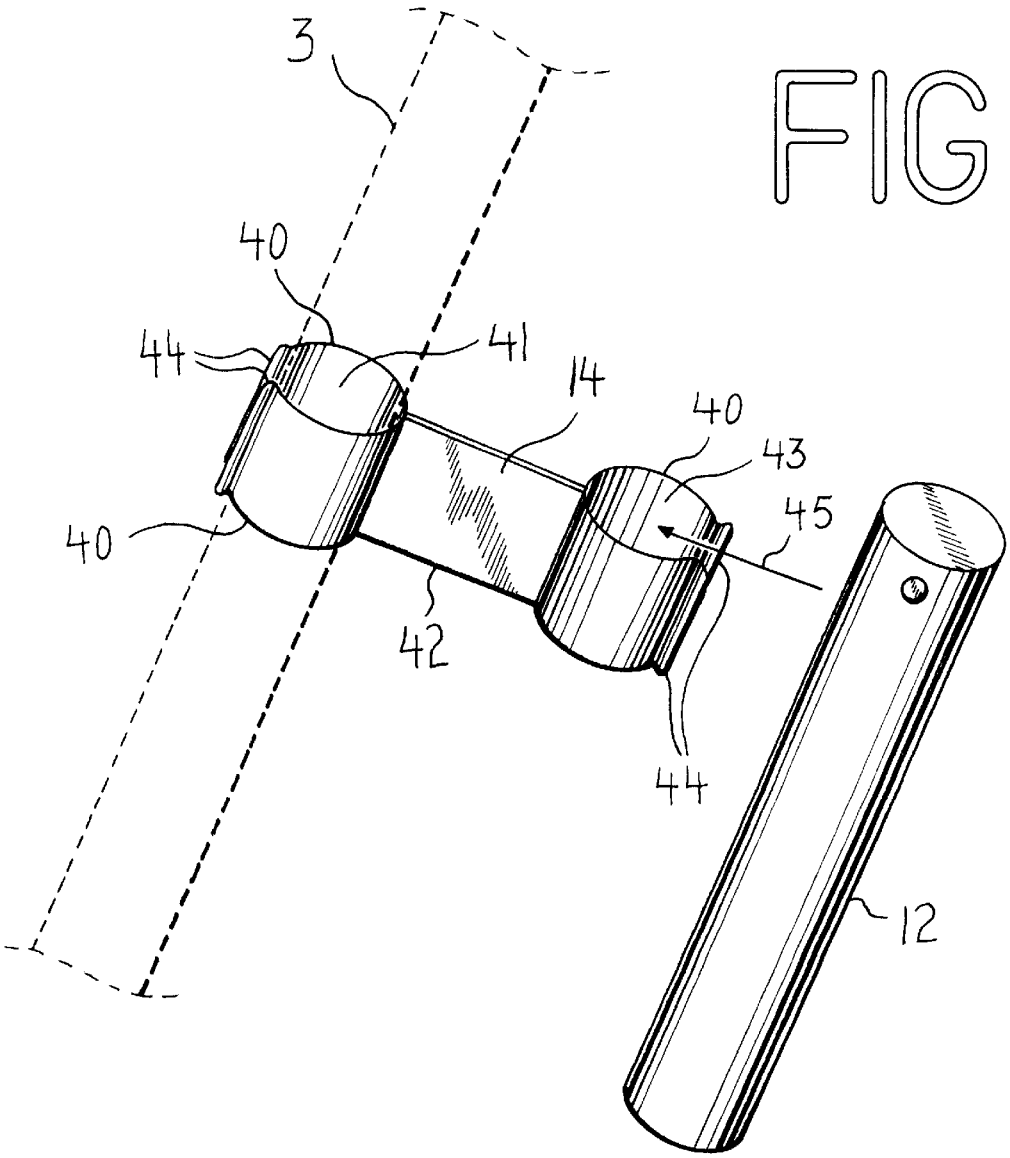
FIG. 4 is a front isometric view of a shaft laser clamp mounted on a golf club shaft, ready to be attached to a shaft laser.

FIG. 4 is a front isometric view of shaft laser clamp 14 mounted on golf club shaft 3, ready to be attached to shaft laser 12. Shaft laser clamp 14 comprises pairs of opposing fingers 40 mounted to opposite extremes of body 42. Fingers 40 terminate in outwardly curved lips 44 disposed at on edge of each finger 40 opposite body 42.

One pair of fingers 40 defines first handle laser clamp aperture 41 at one extreme of body 42, and another pair of fingers 40 defines second handle laser clamp aperture 43 at an extreme of body 42 opposite first handle laser clamp aperture 41. First handle laser clamp aperture 41 is sized to frictionally engage shaft 3, and second handle laser clamp aperture 43 is sized to frictionally engage shaft laser 12. Lips 44 facilitate snapping shaft 3 into first handle laser clamp aperture 41, and snapping shaft laser 12 into second handle laser clamp aperture 43 as indicated by arrow 45. In the preferred embodiment, fingers 40 and lips 44 were manufactured of resilient material such as springy metal, resilient synthetic, or other appropriate material.

In practice, handle laser 12 is snapped into second handle laser clamp aperture 43, and then shaft 3 is snapped into first handle laser clamp aperture 41, such that shaft laser beam 11 is positioned parallel to shaft 3, and shines immediately in front of the area of head 18 intended to hit a golf ball.

In the preferred embodiment, handle laser 6 and shaft laser 12 were commercially available, self-contained battery powered lasers with integral ON/OFF switches.

Method of Teaching:

FIGS. 5–11 depict golf student 48 using golf teaching apparatus 2 to maintain golf club 4 entirely within the perfect swing plane throughout his swing, by keeping handle laser beam 7 and shaft laser beam 11 shining on retractable target line 20 centerline 28 during appropriate arcs of the swing. Tape 26 has been completely extended, with golf ball image 30 and centerline 28 facing up. Both lasers 6 and 12 are turned on.

Figure 5:
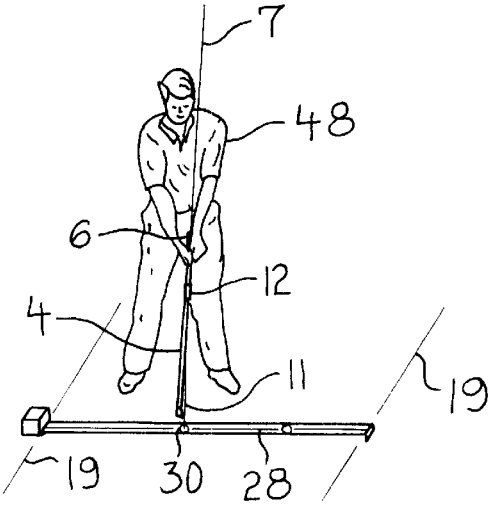
FIGS. 5–11 depict a golf student using the instant golf teaching apparatus and method to maintain his stroke entirely within the perfect swing plane, by keeping the handle laser beam and shaft laser beam shining on the retractable target line centerline.

FIG. 5 shows golf student 48 addressing an imaginary golf ball placed on the center golf ball image 30 with golf club 4. Handle laser 12 emitting handle laser beam 7, and shaft laser 12 emitting shaft laser beam 1 1 have been mounted on golf club 4.

FIGS. 5–8 depict the backstroke portion of the swing, wherein golf student 48 swings golf club 4 backwards opposite the intended direction of travel of an imaginary golf ball placed on golf ball image 30. Throughout the backswing, forward swing, and follow-through portion of the swing, either handle laser beam 7 or shaft laser beam 11 shine on centerline 28, whenever golf club 4 describes an arc whose secant is centerline 28. In this manner golf student 48 can visually confirm his swing is within the perfect swing plane. Note in FIGS. 5 and 6 shaft laser beam 11 shines on centerline 28, while in FIGS. 7 and 8 handle laser beam 7 shines on centerline 28.

Figure 8:
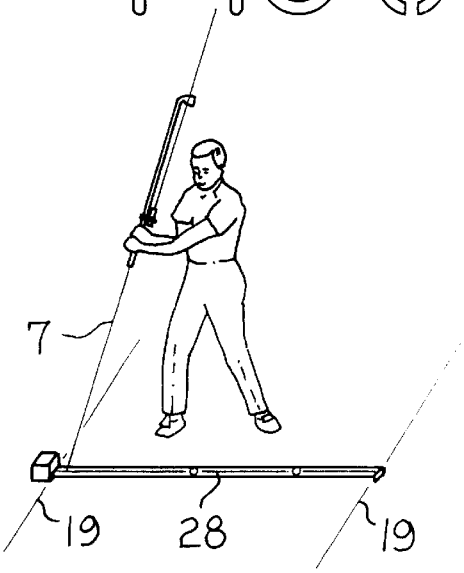
Figure 9:
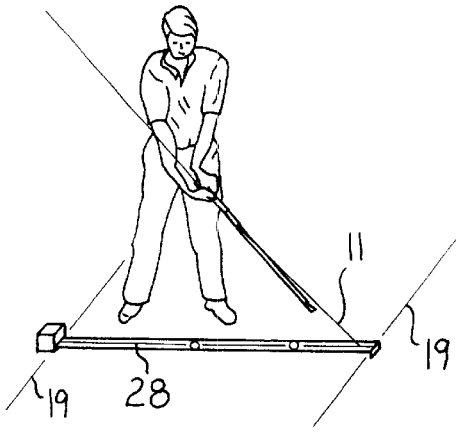
Figure 10:
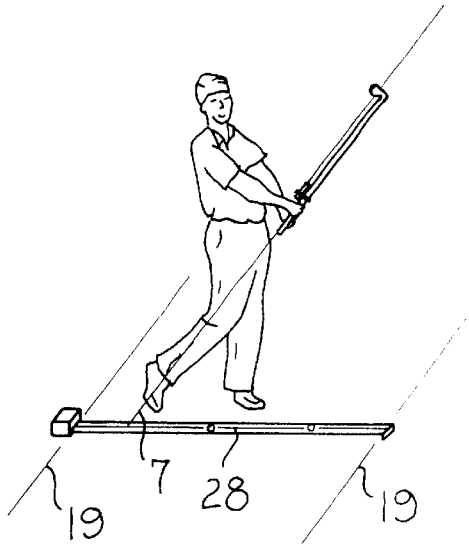
Figure 11:
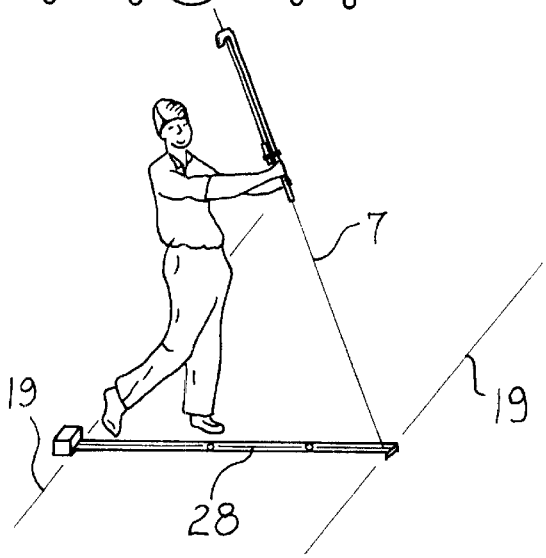

The forward portion of the swing is depicted in FIGS. 8–5, in descending order. The follow-through portion of the swing is depicted in FIGS. 9–11. Note that in FIG. 9, shaft laser beam 11 shines on centerline 28, while in FIGS. 10 and 11 handle laser beam 7 shines on centerline 28.

Figure 6:
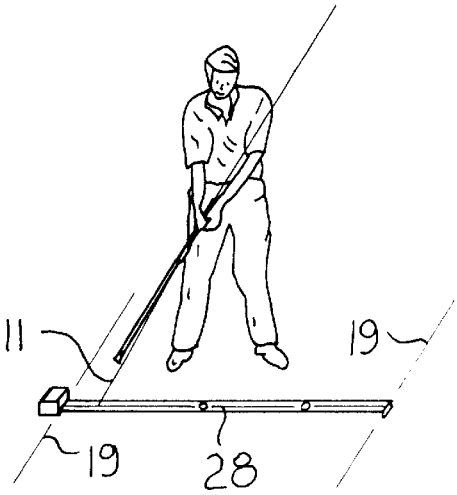
Figure 7:
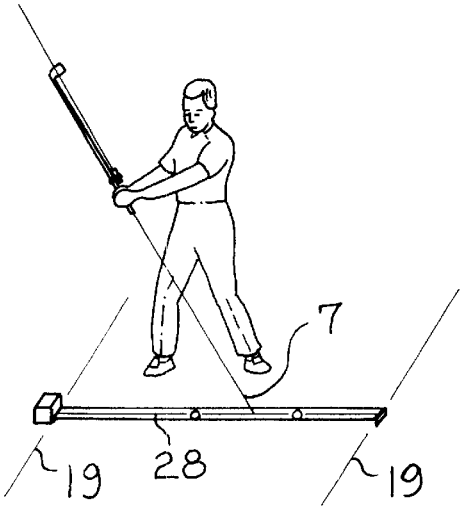

The method of teaching consists of the following steps:

A. Completely extending tape 26 and placing it on a practice surface, ball image 30 and centerline 28 facing up (tape 26 needs only be half extended to practice putting);

B. Mounting handle laser 6 on a butt end of handle 16 such that handle laser beam 7 shines along a centerline of shaft 3 in a direction opposite head 18;

C. Mounting shaft laser 12 on shaft 3 such that shaft laser beam 11 is parallel to shaft 3, and shines immediately in front of a surface of head 18 intended to hit a golf ball;

D. Turning on handle laser 6 and shaft laser 12;

E. Standing facing tape 26 at a ball image 30 (the center ball image 30 to practice driving, the off-center ball image 30 to practice putting) and addressing the selected golf ball image with golf club 4 as if the selected golf ball image 30 were going to be hit along centerline 28, at a distance which permits head 18 to pass directly over the selected ball image 30 during a conventional swing;

F. Ensuring that shaft laser beam 11 shines on centerline 28;

G. Swinging golf club 4 as if to hit a golf ball positioned on the selected golf ball image 30;

H. Ensuring that shaft laser beam 11 shines on centerline 28 during a portion of the backswing during which a surface tracing of shaft laser beam 11 travels between a pair of mutually parallel surface lines 19 which are perpendicular to centerline 28 and which each contain one endpoint of centerline 28, as depicted in FIGS. 5 and 6;

I. Ensuring that handle laser beam 7 shines on centerline 28 during a portion of the backswing during which a surface tracing of handle laser beam 7 travels between surface lines 19, as depicted in FIGS. 7 and 8;

J. Ensuring that handle laser beam 7 shines on centerline 28 during a portion of the forward swing during which a surface tracing of handle laser beam 7 travels between surface lines 19, as depicted in FIGS. 8 and 7 in descending order;

K. Ensuring that shaft laser beam 11 shines on centerline 28 during a portion of the forward swing during which a surface tracing of shaft laser beam 11 travels between surface lines 19, as depicted in FIGS. 6 and 5 in descending order;

L. Ensuring that shaft laser beam 11 shines on centerline 28 during a portion of the follow-through swing during which a surface tracing of shaft laser beam 11 travels between surface lines 19, as depicted in FIG. 9;

M. Ensuring that handle laser beam 7 shines on centerline 28 during a portion of the follow-through swing during which a surface tracing of handle laser beam 7 travels between surface lines 19, as depicted in FIGS. 10 and 11; and N. Where handle laser beam 7 or shaft laser beam 11 do not shine on centerline 28 as required by steps F–M above, modifying the swing of golf club 4 until handle laser beam 7 and shaft laser beam 11 do shine on centerline 28 as required by steps F–M above.

While a preferred embodiment of the invention has been illustrated herein, it is to be understood that changes and variations may be made by those skilled in the art without departing from the spirit of the appending claims.

DRAWING ITEM INDEX

2 golf teaching apparatus
3 shaft
4 golf club
6 handle laser

7 handle laser beam
8 switch
10 handle laser clamp
11 shaft laser beam
12 shaft laser
14 shaft laser clamp
16 handle
18 head
19 surface line
20 retractable target line
22 lock
24 housing
26 tape
28 centerline
30 ball image
32 stop
34 base
36 upper arm
38 lower arm
40 finger
41 first handle laser clamp aperture
42 body
43 second handle laser clamp aperture
44 lip
45 arrow
46 handle laser clamp aperture
48 golf student
50 arrow
52 arrow

I claim:

1. A golf teaching method using a golf teaching apparatus, said golf teaching apparatus comprising a golf club, a handle laser removably mounted to said golf club's handle, a shaft laser removably mounted to said golf club's shaft, and a tape marked with a centerline and at least one ball image, said handle laser being mounted so as to shine a handle laser beam along a centerline extension of said shaft in a direction opposite said golf club's head, and said shaft laser being aimed to shine a shaft laser beam parallel said shaft centerline, said shaft laser beam passing immediately adjacent a portion of said head intended to strike a golf ball, said golf teaching method comprising the steps of:

A. Placing said tape on a practice surface, said ball image and said centerline facing up;

B. Standing facing said tape at said ball image and addressing an imaginary golf ball resting on said golf ball image with said golf club as if said imaginary golf ball were going to be hit along said centerline;

C. Ensuring that said shaft laser beam shines on said centerline;

D. Swinging said golf club so as to hit said imaginary golf ball;

E. Ensuring that said shaft laser beam shines on said centerline during a portion of a backswing during which a surface tracing of said shaft laser beam travels between a pair of mutually parallel surface lines which are perpendicular to said centerline and which each contain one endpoint of said centerline;

F. Ensuring that said handle laser beam shines on said centerline during a portion of said backswing during which a surface tracing of said handle laser beam travels between said pair of surface lines;

G. Ensuring that said handle laser beam shines on said centerline during a portion of a forward swing during which a surface tracing of said handle laser beam travels between said pair of surface lines; and H. Ensuring that said shaft laser beam shines on said centerline during a portion of said forward swing during which a surface tracing of said shaft laser beam travels between said pair of surface lines.

2. The golf teaching method of claim 1 comprising the further step of:

I. Where said handle laser beam or said shaft laser beam do not shine on said centerline as required by steps C–H above, modifying a swing of said golf club until said handle laser beam and said shaft laser beam do shine on said centerline as required by steps C–H above.

3. The golf teaching method of claim 1 comprising the further step of:

I. Ensuring that said shaft laser beam shines on said centerline during a portion of a follow-through swing during which a surface tracing of said shaft laser beam travels between said pair of surface lines; and J. Ensuring that said handle laser beam shines on said centerline during a portion of said follow-through swing during which a surface tracing of said handle laser beam travels between said pair of surface lines.

4. The golf teaching method of claim 3 comprising the further step of:

K. Where said handle laser beam does not shine on said centerline as required by steps C–J above, modifying a swing of said golf club until said handle laser beam does shine on said centerline as required by steps C–J above.

5. A golf teaching method using a golf teaching apparatus, said golf teaching apparatus comprising a golf club, a handle laser removably mounted to a handle of said golf club, a shaft laser removably mounted to a shaft of said golf club, and a target line member marked with a target line, said handle laser being mounted to shine a handle laser beam in a direction opposite of the head of said golf club, and said shaft laser being aimed to shine a shaft laser beam adjacent a portion of the head of said golf club intended to strike a golf ball, said method comprising:

placing the target line member on a practice surface so that target line faces up;

standing so as to face the target line member and addressing an imaginary golf ball as if the imaginary golf ball were going to be hit along the target line;

ensuring that the shaft laser beam shines on the target line;

swinging the golf club so as to hit the imaginary golf ball;

ensuring that the shaft laser beam shines on and moves along the target line during part of a backswing part of said swinging;

ensuring that the handle laser beam shines on and moves along the target line during another part of the backswing part of said swinging;

ensuring that the handle laser beam shines on and moves along the target line during a part of a forward swing part of said swinging; and ensuring that the shaft laser beam shines on and moves along the target line during another part of the forward swing part of said swinging.

6. The teaching method of claim 5, and further comprising repeating said swinging while modifying a swing technique when the handle laser beam or the shaft laser beam deviate from moving along the target line during said swinging.

7. The teaching method of claim 5, and further comprising ensuring that the shaft laser beam shines on and moves along the target line during a part a follow-through part of said swinging and ensuring that the handle laser beam shines on and moves along the target line during another part of the follow-through part of said swinging.

8. The teaching method of claim 7, and further comprising repeating said swinging while modifying a swing technique when the handle laser beam or the shaft laser beam deviate from moving along the target line during any of the parts of said swinging.

* * * * *

UNITED STATES PATENT AND TRADEMARK OFFICE

CERTIFICATE OF CORRECTION

PATENT NO. : 6,488,592 B1
DATED : December 3, 2002
INVENTOR(S) : Barry D. Boatner It is certified that error appears in the above-identified patent and that said Letters Patent is hereby corrected as shown below:

Title page, Item [54] and Column 1, lines 1 and 2,
Change "APPARATUS AND METHOD FOR TEACHING GOLF" to -- METHOD FOR TEACHING GOLF --;
Item [56], References Cited, U.S. PATENT DOCUMENTS, change
"5,388,831 A 2/1995 Quandri et al. . . . . 473/220" to
-- 5,388,831 A * 2/1995 Quadri et. . . . . 473/220 --; and insert
-- 5,544,075 * 9/1996 Glazer --.

Signed and Sealed this

Twenty-third Day of December, 2003

JAMES E. ROGAN
*Director of the United States Patent and Trademark Office*